US008023684B2

(12) United States Patent
Wathen

(10) Patent No.: US 8,023,684 B2
(45) Date of Patent: Sep. 20, 2011

(54) SPEAKER/BRACKET ASSEMBLY

(75) Inventor: David Wathen, Los Angeles, CA (US)

(73) Assignee: Sanecor Musical Instrument (Shenzhen) Co., Ltd., Shenzhen (CN)

( * ) Notice: Subject to any disclaimer, the term of this patent is extended or adjusted under 35 U.S.C. 154(b) by 491 days.

(21) Appl. No.: 12/269,565

(22) Filed: Nov. 12, 2008

(65) Prior Publication Data

US 2010/0051773 A1 Mar. 4, 2010

(30) Foreign Application Priority Data

Aug. 29, 2008 (CN) ..... 2008 1 0142122

(51) Int. Cl.
*H04R 1/02* (2006.01)

(52) U.S. Cl. ..... 381/387; 381/386; 381/395

(58) Field of Classification Search ..... 381/386–388, 381/392, 395

See application file for complete search history.

(56) References Cited

U.S. PATENT DOCUMENTS 5,201,896 A * 4/1993 Kruszewski ..... 248/278.1
6,891,957 B2 * 5/2005 Manrique et al. ..... 381/386
7,455,271 B2 * 11/2008 Pincek et al. ..... 248/288.31
7,532,735 B2 * 5/2009 Whitehouse et al. ..... 381/387

* cited by examiner

*Primary Examiner* — Ramon M Barrera
(74) *Attorney, Agent, or Firm* — Hamre, Schumann, Mueller & Larson, P.C.

(57) ABSTRACT

The present invention discloses a speaker/bracket assembly. The speaker/bracket assembly comprises a speaker and a bracket for supporting the speaker thereon. The speaker defines a slide groove at a back face thereof. The bracket comprises a latching mechanism configured to be loosened to adjust and tightened to set the speaker position. The latching mechanism comprises a brake, a pair of latch hooks disposed on the brake, and a drive mechanism interposed between the pair of latch hooks. A spring is secured on the drive mechanism. The pair of latch hooks is loosened to set the speaker position and snaps into the slide groove to lock the speaker into the set position when the spring is pushed in and drawn back out the brake by the drive mechanism.

20 Claims, 9 Drawing Sheets

SPEAKER/BRACKET ASSEMBLY

FIELD OF THE INVENTION

The present invention relates to speaker fixing systems and, more particularly, to a speaker/bracket assembly having a bracket which provides an orientation adjustment of the speaker.

BACKGROUND

The demand for high-quality speakers has increased dramatically over the last twenty years. As a consequence, there is a large selection of high-quality speakers available on the market. To meet with popularity of various kinds of speakers, a variety of speaker fixing systems for fixing and supporting the speakers are developed.

It is known that the positioning, arrangement and orientation of speakers in commercial and residential settings can affect the quality of sound from a sound system. Currently, many approaches have been taken to the positioning of speakers in a room, cinema, theaters, or vehicle, in order to optimize the quality of sound from a system. In general, there are three types of speakers fixing systems.

One typical speaker fixing system is a speaker stand which supports a speaker above a horizontal surface such as a floor. The speaker stand does provide vertical adjustment and provides limited options to locate a speaker. Further, the speaker stand occupies a partial area of the floor, accordingly decreasing effective area available for arranging other furnishings.

The second type of speaker fixing system is a hanging mounting system which suspends a speaker from the ceiling by toggle bolts. However, in order to use toggle bolts, it is necessary to make additional holes in the ceiling panel to receive the toggle bolts. Such an arrangement is unsuitable for a speaker and its associated bracket having large weight. Further, due to the height of the ceiling, it is inconvenient to install the speaker and the fixing system by toggle bolts in the ceiling.

The third type of speaker fixing system is a fixed mounting bracket that will rigidly attach a speaker to a wall by toggle bolts. Some fixed mounting brackets are problematic, because they do not provide a fixed speaker angle adjustment. Other mounting brackets may include a base and an adjustment arm and may optionally include a pivoting point. The pivoting point may be physically attached between the base and the adjustment arm, for adjusting the orientation angle of the speaker. However, this pivoting mounting bracket is problematic, because the pivot point together with the adjustment arm may not provide an accurate user defined adjustment angle for the speaker orientation or a secure mount. Further, the pivoting point will wear over time and with use, thereby causing the speaker to fall from adjustment and even producing injury to person under the speaker.

Moreover, there is a spherically adjustable mounting bracket, which allows for adjustment along multiple planes by means of a ball and socket joint. In the typical design, a ball is mounted within a stationary socket. The socket is required to envelope a majority of the ball so that the speaker may be mounted securely by a pressure force locking mechanism, such that the speaker does not easily come loose from its fixed position. Although this configuration allows a speaker to be mounted along multiple plans, the range of adjustment afforded by this design is substantially restricted by the fact that the socket is required to envelope a significant portion of the stationary ball.

There is, therefore, a need for a speaker/bracket assembly which may accurately and swiftly achieve a repeatable orientation adjustment of the speaker, and have an enlarged range of adjustment.

SUMMARY

In accordance with an aspect of the present invention, a speaker/bracket assembly comprises a speaker and a bracket for supporting the speaker thereon. The speaker defines a slide groove at a back face thereof. The bracket comprises a latching mechanism configured (i.e., structured, adapted or arranged) to be loosened to adjust and tightened to set the speaker position. The latching mechanism comprises a brake, a pair of latch hooks disposed on the brake, and a drive mechanism interposed between the pair of latch hooks. A spring is secured on the drive mechanism. The pair of latch hooks is loosened to set the speaker position and snaps into the slide groove to lock the speaker into the set position when the spring is pushed in and drawn back out the brake by the drive mechanism.

In operation, user can drive the drive mechanism to cause the spring to be pushed in the brake, and then the pair of latch hooks becomes loosened. Accordingly, the user can freely set the speaker position and change the orientation angle of the speaker. After adjusting to desired speaker position, user can drive back the drive mechanism to cause the spring to be drawn back out the brake, and then the pair of latch hooks tightly snaps into the slide groove, thereby locking the speaker into desired position. During the entire operation process, the adjustment to the speaker can be accurately and swiftly achieved and requires low time consumption. The range of adjustable angle depends on the radian of the slide groove. In practical application, the radian or length of slide groove can be predesigned to be enough large, thereby enlarging the range of the adjustable angle of the speaker.

Other objects, advantages and novel features of the present invention will become more apparent from the following detailed description when taken in conjunction with the accompanying drawings.

DETAILED DESCRIPTION OF THE PREFERRED EMBODIMENTS

Objects, advantages and embodiments of the present invention will be explained below in detail with reference to the accompanying drawings. However, it is to be appreciated that the following description of the embodiment(s) is merely exemplary in nature and is no way intended to limit the invention, its application, or uses.

Figure 1:
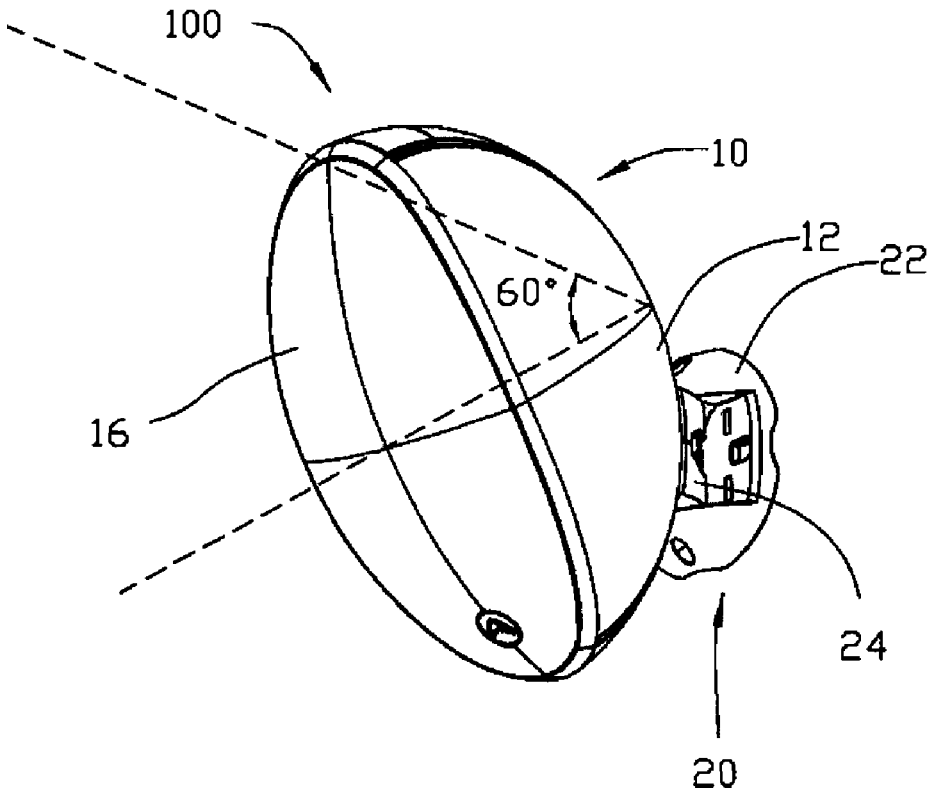
FIG. 1 is a schematic, isometric view of a speaker/bracket assembly according to a preferred embodiment of the present invention.
Figure 2:
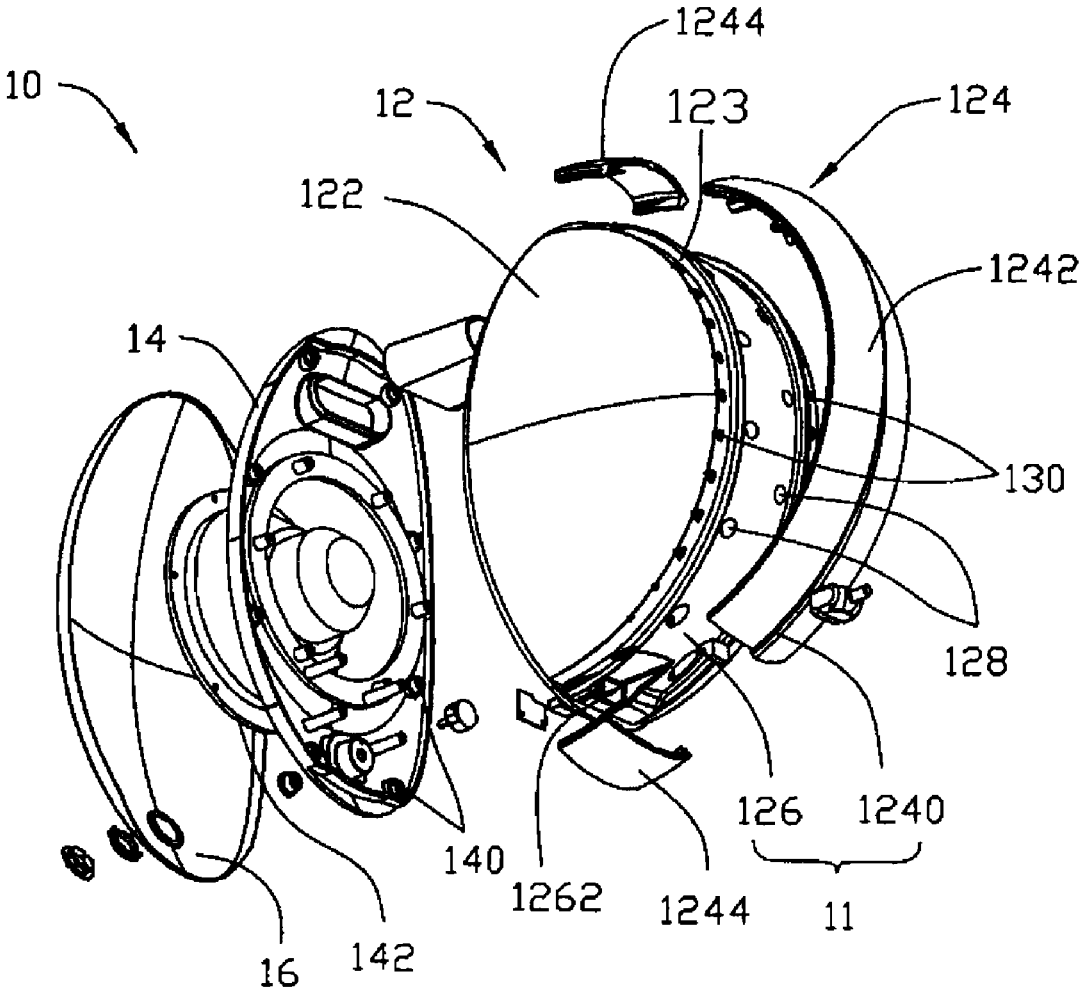
FIG. 2 is a schematic, exploded view of a speaker of the speaker/bracket assembly of FIG. 1.

Referring to FIGS. 1 and 2, a speaker/bracket assembly 100, in accordance with an embodiment of the present invention, comprises a speaker 10 and a bracket 20 for supporting the speaker 10 thereon. The speaker 10 defines a slide groove 11 at a back face thereof. The bracket 20 includes a latching mechanism configured to be loosened to adjust and tightened to set the speaker position.

Figure 5:
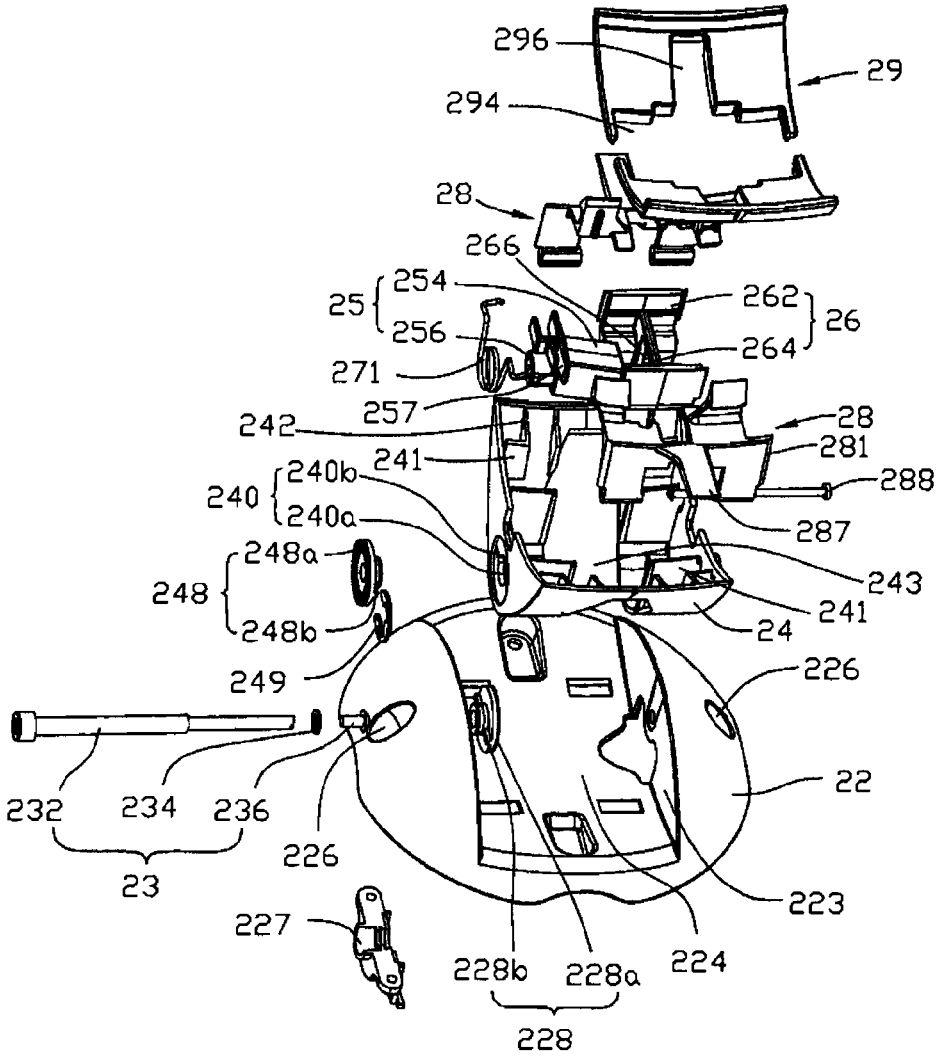
FIG. 5 is a schematic, exploded view of the bracket of FIG. 4.

The latching mechanism comprises a brake 26, a pair of latch hooks 28 disposed on the brake 26, and a drive mechanism interposed between the pair of latch hooks 28, as shown in FIG. 5. A spring 271 is secured on the drive mechanism. The pair of latch hooks 28 is loosened to set the speaker 10 position when the spring 271 is pushed in the brake 26. The pair of latch hooks 28 snaps into the slide groove 11 to lock the speaker 10 into the set position when the spring 271 is drawn back out the brake 26 by the drive mechanism.

Figure 3:
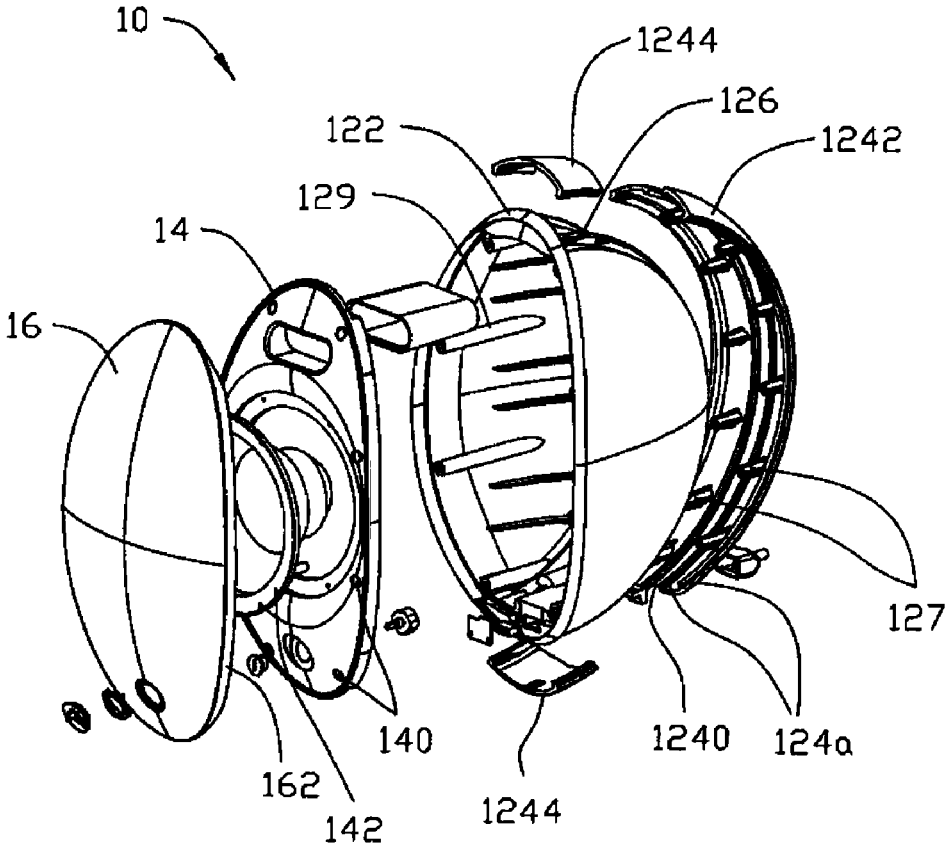
FIG. 3 is similar to FIG. 2, but showing the speaker of the speaker/bracket assembly of FIG. 1 at another angle of view.

Referring to FIGS. 2 and 3, the speaker 10 includes an outer shell 12, an inner fixing frame 14, and an outer cover 16 covering the outer shell 12. The outer shell 12 includes a shell body 122 and a backing 124 disposed at the back of the shell body 122. The shell body 122 is in a partial spherical or ellipsoidal shape. The shell body 122 has an arched (i.e., arcuated) backbone portion 123. The slide groove 11 is defined in the backbone portion 123 and the backing 124. The backbone portion 123 defines an arched groove 126 elongated along the arched outline thereof. The backing 124 is fixed at the backbone portion 123 and covers the arched groove 126. Accordingly, the backing 124 is an arched cover to provide a smooth and curved orbit for slide of the latching mechanism. The shell body 122, the inner fixing frame 14, and the outer cover 16 is fixed as a whole, for example, by mechanical engagement means.

The backing 124 includes a central portion 1242 and two end portions 1244 disposed at two opposite margins of the central portion 1242. The two end portions 1244 are separated from the central portion 1242. The two end portions 1244 closely contact the central portion 1242 so as to forms a continuous curved backing 124. Further, a cavity 1262 is defined in a bottom of the groove 126. Some parts associated with the speaker/bracket assembly 100, for example cables or wires, may be accommodated in the cavity 1262. The two end portions 1244 can be separately taken away from the backbone portion 123. Thus, in use, any one of the two end portions 1244 can be opened to take out of parts received in the arched groove 126 or put parts into the arched groove 126.

The central portion 1242 defines a slot 1240 along a central line thereof. The slot 1240 may run through the entire central portion 1242 and extends along arched outline of the central portion 1242, as shown in FIGS. 2 and 3. The central portion 1242 thereby is split into two uniform arched parts. Each arched part extends two opposing flanges 124*a* at two arched edges thereof.

A plurality of threaded poles 127 is protruded from an inner surface of the backing 124. Each threaded poles 127 defines a group of inner thread. A plurality of holes 128 is defined at the backbone portion 123 in correspondence to the plurality of threaded poles 127. Each threaded pole 127 is inserted into one respective hole 128 and receives a bolt, thereby fixing the backing 124 onto the shell body 122. After the backing 124 is fixed to the shell body 122, the slot 1240 and the arched groove 126 cooperatively form the slide groove 11. In this structure, the arched groove 126 serves as an inner groove space of the slide groove 11 and the slot 1240 serves as a groove opening of the slide groove 11. The slot 1240 advantageously has a slot width smaller than a groove width of the arched groove 126. That is, the slide groove 11 has a T-shaped void in a cross sectional direction. Such a slide groove 11 provides an advantageous aid in holding the latching mechanism (e.g., the latch hooks) therein.

Further, at least one line of scale 130 is graduated along the backbone portion 123. In the illustrated embodiment, there are two lines of scales 130 graduated at two edges of the backbone portion 123. In this embodiment, the central portion 1242 of the backing 12 has a radian of about 120°. The graduated scales 130 have a scale range of about 0-120 degree. For example, the graduated scales 130 have twelve scales and thus the scale interval is 10°. Ten sub-scales may be marked between adjacent scales. The scales 130 can provide a precision guide to accurately adjust orientation angle of the speaker 10. It is to be appreciated that the central portion 1242 of the backing 12 could have an arched angle larger than 120 degree, accordingly increasing radian of the slide groove 11 and thus obtaining wider adjustable amplitude of the speaker.

The inner fixing frame 14 is fixed to an inner wall of the outer shell 12 by, e.g., a bolt. In the illustrated embodiment, the inner wall of the outer shell 12 extends a plurality of threaded projections 129. The inner fixing frame 14 defines a plurality of orifices 140. The plurality of threaded projections 129 is provided with inner thread. The plurality of threaded projections 129 is respectively penetrated through the plurality of orifices 140. A plurality of bolt is applied to engage the threaded projections 129, thereby fixing the inner frame 14 to the outer shell 12.

The inner fixing frame 14 is entirely an elliptical panel and is accommodated into the outer shell 12. An audio generator, for example a loudspeaker 142, is disposed at the center of the inner fixing frame 14. The cover 16 may be cambered outwards and cooperates with the inner fixing frame 14 to form a space for receiving the loudspeaker 142.

The cover 16 is in a web or mesh shape to allow sound spread therethrough. The cover 16 directly covers on the inner fixing frame 14. For example, the cover 16 has a cover flange 162 for snapping upon edges of the inner fixing frame 14. In other embodiments, the cover 16 could be fixed to inner fixing frame 14 by a screw.

Referring to FIGS. 4 through 7, besides the latching mechanism, the bracket 20 further includes a substrate 22 and a clamp cup assembly 24 in connection with the substrate 22 by a drive screw 23. The drive screw 23 includes a screw shaft 232, a ring 234 wound around an end of the screw shaft 232, and a bolt 236. The end of the screw shaft 232 defines inner thread for engaging the bolt 236. The ring 234 may slide along the bolt 236 but is not permitted to pass through the end of the screw shaft 232.

The substrate 22 is provided with two opposite inner walls 223 projecting from the substrate 22. The two inner walls 223 cooperatively define a sunken recess 224 therebetween for receiving the clamp cup assembly 24 therein. The two inner walls 223 define two orifices 226 to allow the drive screw 23 to pass through. One of the two inner walls 223 forms a semicircle ring 225 which cooperates another semicircle ring 227 to define a central aperture and a ditch extending along a diameter direction. The two semicircle rings 225 and 227 engage together by, e.g., a screw. The semicircle ring 227 may depart from the semicircle ring 225 by disassembling the screw.

A first knurl ring 228 is disposed against the semicircle ring 225 and has a central hole for allowing the drive screw 23 to pass through. The first knurl ring 228 includes a first knurl part 228*a* and an elongated first rib 228*b* along a diameter direction thereof. The first rib 228*b* is used to insert into the ditch of the semicircle ring 225, thereby securing the first knurl ring 228 on the semicircle ring 225 of the substrate 22. A plurality of threaded pins 229 are formed in a bottom of the recess 224 of the substrate 22, for fixing the substrate 22 to an external base, e.g., a wall by screws.

The clamp cup assembly 24 is, advantageously, a shell in a cup form. The clamp cup assembly 24 has a V-shaped cross section. The clamp cup assembly 24 forms a receiving cavity for receiving the latching mechanism therein. The clamp cup assembly 24 includes an arched bottom wall 24*a* with two turn-up ends and two semicircle or crescent side walls 24*b* adjoining the arched bottom wall 24*a* at two sides of the bottom wall 24*a*. A plurality of upright ribs 241 is arranged on the bottom wall 24*a*, for supporting the latching mechanism thereon. The bottom wall 24*a* defines an arched opening 243 extending along an arched central line of the bottom wall 24*a*.

One side wall 24*b* of the clamp cup assembly 24 defines a recess corresponding to the semicircle ring 225. The recess defines an opening 240. The opening 240 includes a central opening 240*a* for allowing the drive screw 23 to pass through and a ditch 240*b*. A second knurl ring 248 is inserted into the recess. The second knurl ring 248 includes a second knurl part 248*a* engaging the first knurl part 228*a* and an elongated second rib 248*b* along a diameter direction thereof. The ditch 240*b* receives the second rib 248*b*, accordingly securing the second knurl ring 248 onto the clamp cup assembly 24. The drive screw 23 further passes through the second knurl ring 248. The second knurl ring 248 is disposed outside the side wall 24*b*. A C-shaped ring 249 is interposed between the recess in the side wall 24*b* and the second knurl ring 248 to force the first knurl rings 228 to closely engage the second knurl ring 248. When the two knurl rings 228 and 248 tightly engage with each other, the clamp cup assembly 24 revolves along with the substrate 22. Although the drive screw 23 passes through the two knurl rings 228 and 248, the two knurl rings 228 and 248 are independent of the rotation of the drive screw 23. The substrate 22 and the clamp cup assembly 24, as well as the two knurl rings 228 and 248, do not revolves along with the rotation of the drive screw 23. While disassembling the bracket 20, the semicircle ring 227 is firstly removed from the semicircle ring 225, and then the drive screw 23 is drawn out of the orifices 226. The first and second knurl rings 228 and 248 are apart from each other, thereby detaching the clamp cup assembly 24 from the substrate 22.

Furthermore, the sunken recess 224 has a length along an axial direction of the drive screw 23 larger than that of the clamp cup assembly 24. Accordingly, the clamp cup assembly 24 may transfer along the drive screw 23 and smoothly revolve along the drive screw 23 to a desired orientation. The latching mechanism is driven to sway around the drive screw 23 along with the clamp cup assembly 24. While adjusting the clamp cup assembly 24 to desired position, the drive screw 23 is driven to cause clamp cup assembly 24 to secure the clamp cup assembly 24 on the substrate 22. Accordingly, swaying amplitude of the speaker 10 around the drive screw 23 can be regulated by the rotation of the clamp cup assembly 24. The swaying amplitude is in the range of, for example, about 90 degree. The swaying amplitude substantially depends on an arc degree (i.e., radian) of the arched bottom wall 24*a* and swaying space where the sunken recess 224 allows the clamp cup assembly 24 to sway around the drive screw 23.

The latching mechanism is disposed in the clamp cup assembly 24. The pair of latch hooks 28 are respectively mounted and distributed on two opposite edges of the brake 26, e.g., arranged on two sides of the drive screw 230. Each latch hook 28 includes an upright panel 281, at least one hook 283 vertically protruding from the upright panel 281, and an aerofoil panel 287 protruding from a side of the upright panel 281 opposite to the hook 283. In the illustrated embodiment, the at least one spaced hook 283 comprises two spaced hooks 283. The two spaced hooks 283 are disposed at one side of the upright panel 281 and are aligned in a line along the axial direction of the drive screw 23. The two spaced hooks 283 and the aerofoil panel 287 are disposed at two opposite sides of the upright panel 281. Each hook 283 includes a connecting panel 282 extending along a direction opposite to the aerofoil panel 287 and an upright hook portion 284 vertically protruding from a free end of the connecting panel 282 along a vertical direction. Each hook portion 284 has a hook-shaped top. For example, the hook-shaped top is in a triangle shape and thus the entire hook portion 284 is in a triangle flag shape, i.e., likes a "4". The hook-shaped top of each hook portion 284 is locked in the arched groove 126 of the slide groove 11 and the other portion of each hook portion 284 is kept out of the slide groove 11. As such, the latch hooks 28 snap into the slide groove 11.

The brake 26 includes an arched support panel 262 and a bridge panel 264. The bottommost of the arched support panel 262 is disposed in the arched opening 243. The support panel 262 includes a central arc portion 263 and two baffles 265 adjoining two ends of the central arc portion 263. The central arc portion 263 has an arched shape matching void shape of the arched opening 243, namely, the central arc portion 263 has the same curvature to the bottom wall 24*a* of the clamp cup assembly 24. The two baffles 265 essentially extend along a vertical direction. The bridge panel 264 is interposed between the two baffles 265 and adjoins the central arc portion of the support panel 262. The bridge panel 264 is substantially perpendicular to the drive screw 23. The bridge panel 264 defines a window 266.

The brake 26 defines two elongated orifices 260 along a direction parallel to the axial of the drive screw 23 at joints between the two baffles 265 and the central arc portion 263. Each latch hook 28 defines an aperture for allowing a connecting shaft 288 to pass through. The connecting shaft 288 further passes through the orifices 260 so as to mount the two latch hooks 28 on the brake 26. Specifically, the two upright panels 281 are disposed against the two baffles 265 of the support panel 262. The upright panel 281 of each latch hook 28 defines an opening 286 facing toward the baffle 265 of the support panel 262. Thus, the two baffles 265 of the support panel 262 seal the two opening 286 of the two upright panels 281, respectively. Each latch hook 28 is pivotally connected to the support panel 262 by the connecting shaft 288, and thus revolves along the connecting shaft 288.

Figure 4:
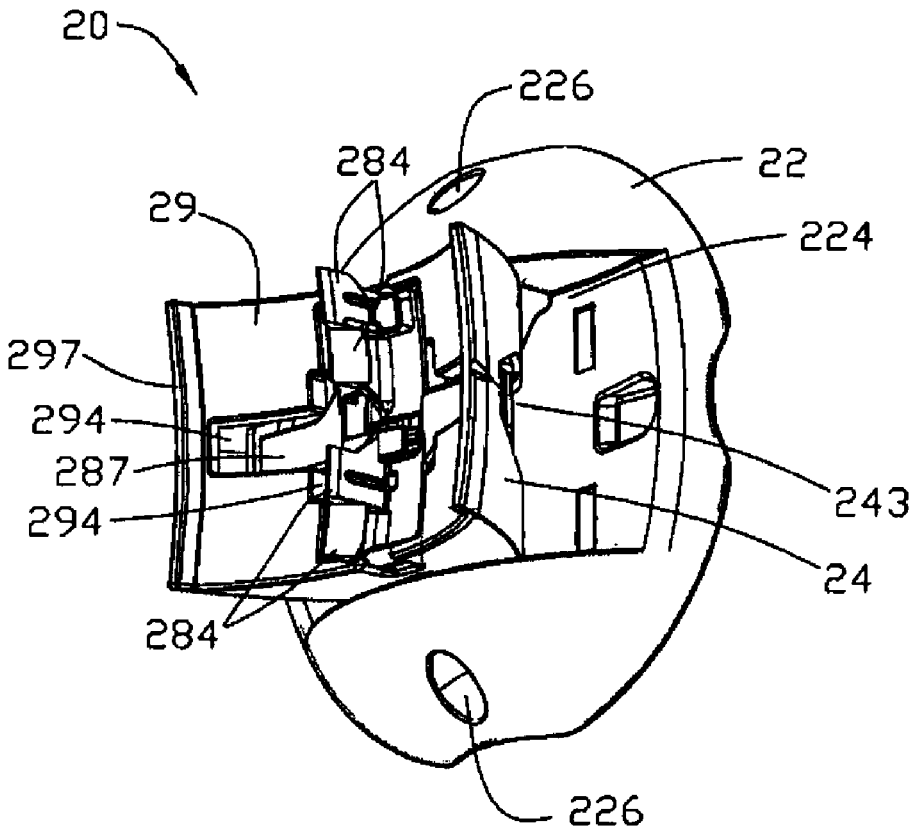
FIG. 4 is a schematic, isometric view of a bracket of the speaker/bracket assembly of FIG. 1.

The two hooks 283 of one latch hook 28 and the two hooks 283 of the other latch hook 28 are alternately spaced and arranged along a line substantially parallel to the axial of the drive screw 23, as shown in FIG. 4. It is to be understood that more or less than two hooks 283 could be formed on every one upright panel 281 for satisfying practical requirement.

Figure 8:
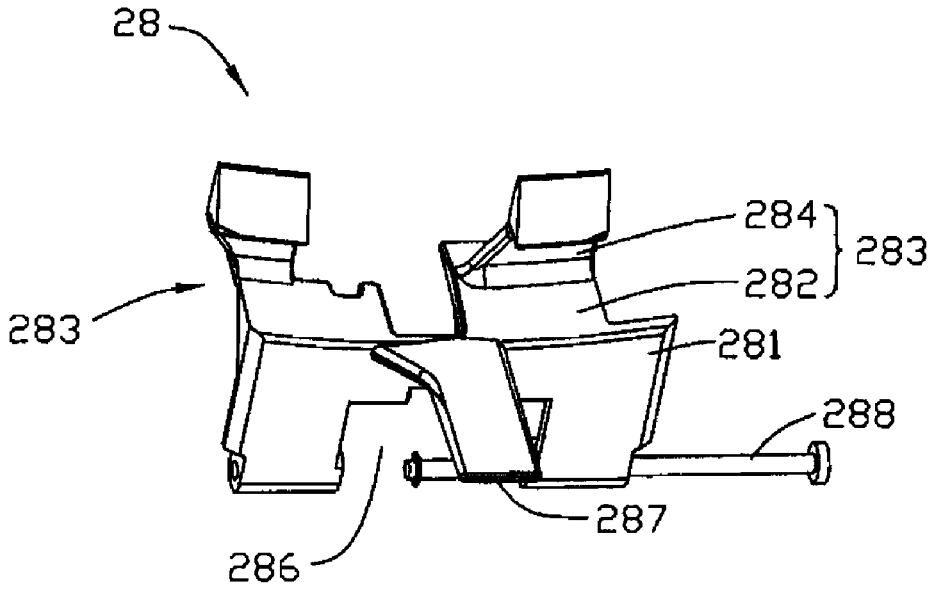
FIG. 8 is a schematic, isometric view of a latch hook of the bracket of FIG. 5.
Figure 9:
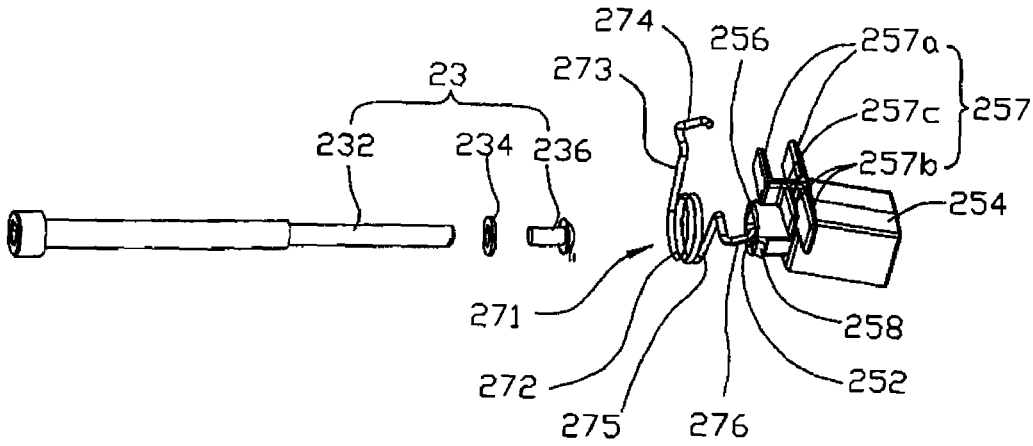
FIG. 9 is a schematic, disassembled view of an adjusting mechanism of the bracket of FIG. 5.

The drive mechanism includes a wedge block 25 and the drive screw 23, as shown in FIGS. 5 and 8. The wedge block 25 has a threaded inner wall 252 for receiving part of the screw shaft 232. The threaded inner wall 252 may extend through the entire length of the wedge block 25 so as to allow the drive screw 23 to pass through the entire wedge block 25. The wedge block 25 includes a wedge portion 254 penetrating through the window 266 of the bridge panel 264 and an end portion 256 disposed far away from the window 266. Due to screwed engagement between the wedge block 25 and the drive screw 23, the wedge portion 254 of the wedge block can be pushed into the window 266 and drawn back out the window 266 by rotation of the drive screw 23 along two inverse directions, e.g., a counterclockwise and clockwise direction. Consequently, the brake 26 and the latch hooks 28 is elevated up and down respectively corresponding to pushing and drawing back the wedge block 25.

The end portion 256 of the wedge block 25 is disposed adjacent the knurl ring 248. The window 266 may be a rectangular void and the wedge block 25 is in a cuboid shape for matching the rectangular window 266. The wedge portion 264 of the wedge block 25 is inclined to the drive screw 23 by a certain angle, e.g., 30 to 60 degree, advantageously 45 degree. The rectangular window 266 allows the wedge block 25 to transfer along the axial direction of the drive screw 23, but prevents the wedge block 25 from rotating around the drive screw 23. In other embodiments, a stop mechanism, for example, including a slot and a pin applied to the wedge block 25 and the window 266, thereby permitting any desired fit shapes of the wedge block 25 and the window 266.

A stop member 257 is disposed at the end portion 256. The stop member 257 includes two pairs of barriers 257*a* and 257*b* and a connecting segment connecting the two pairs of barriers 257*a* and 257*b*. The pairs of barriers 257*a*/257*b* are parallel to each other and are perpendicular to the drive screw 23. Accordingly, the entire stop member 257 is in an "H" form and defines two spaces between the two pairs of barriers 257*a*, 257*b* and the connecting segment 257*c*.

The end portion 256 is advantageously in a cylindrical shape for securing the spring 271. The spring 271 winds around the end portion 256. The spring 271 includes a major spring winding 272 around the end portion 256, two upright spring arms 273 and 275 extending from two ends of the spring winding 272, and two elastic rods 274 and 276 respectively extending from the two spring arms 273 and 275 along a horizontal direction (i.e., axial direction of the drive screw 23). The spring arms 273 and 275 are respectively held in two interspaces defined between the two pairs of barriers 257*a*, 257*b* and the connecting segment 257*c*. The two elastic rods 274 and 276 press against the upright panels 281 of the two latch hooks 28, respectively. In this manner, the spring 271 is held between the two pairs of barriers 257*a* and 257*b* and thus cannot transfer and rotate about the end portion 256. Further, a pair of flanges 258 is disposed at two sides of a diameter of the end portion 256, for preventing the spring 271 from departing from the end portion 256.

Referring to FIGS. 5 through 7 and 9, the two elastic rods 274 and 276 of the spring 271 elastically press against the upright panels 281 to splay out the hook portions 284, thereby tightly locking the latch hooks 28 into the slide groove 11. The elastic rods 274 and 276 of the spring 271 are usefully folded inward to smoothly slide against the upright panels 281 and readily penetrate through openings 286 to press against the two baffles 265 of the brake 26. In operation, the elastic rods 274 and 276 can be pushed in the openings 286 and press against the baffles 265 of the brake 26 by rotating the drive screw 23 to push the wedge block 25 into the window 266. Since interspace between the two baffles 265 of the brake 26 is smaller than that of the two upright panels 281, the latch hooks 28 is relatively loosened in the slide groove 11 when the elastic rods 274 and 276 are pushed in the openings 286. Consequently, the speaker 10 can freely set its position by a relative slide thereof with respect to the latching mechanism. Once drawing back out the wedge block 25 from the window 266 by the rotation of the drive screw 23, the two elastic rods 274 and 276 of the spring 271 slide out of the openings 286 and press against the two upright panels 281 to fasten the two hook portions 284 in the slide groove 11.

Figure 6:
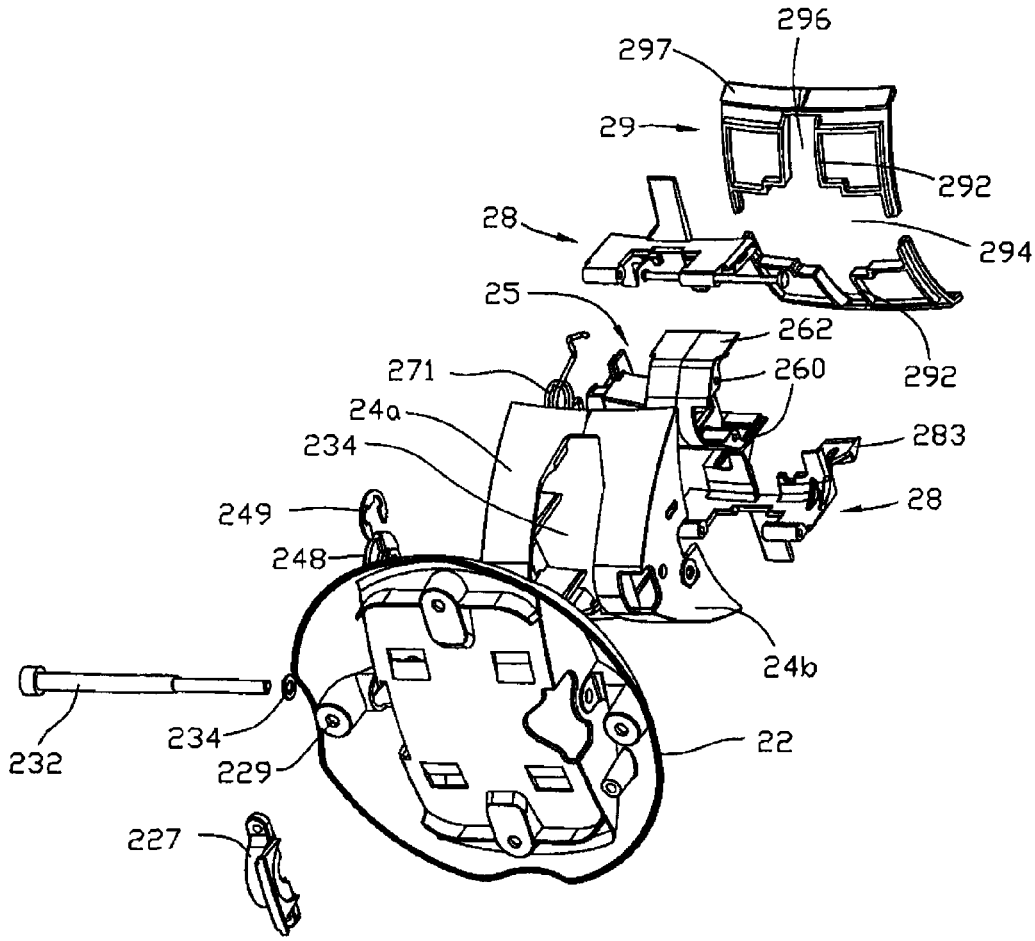
FIG. 6 is similar to FIG. 5, but showing the bracket of the speaker/bracket assembly of FIG. 1 at another angle of view.
Figure 7:
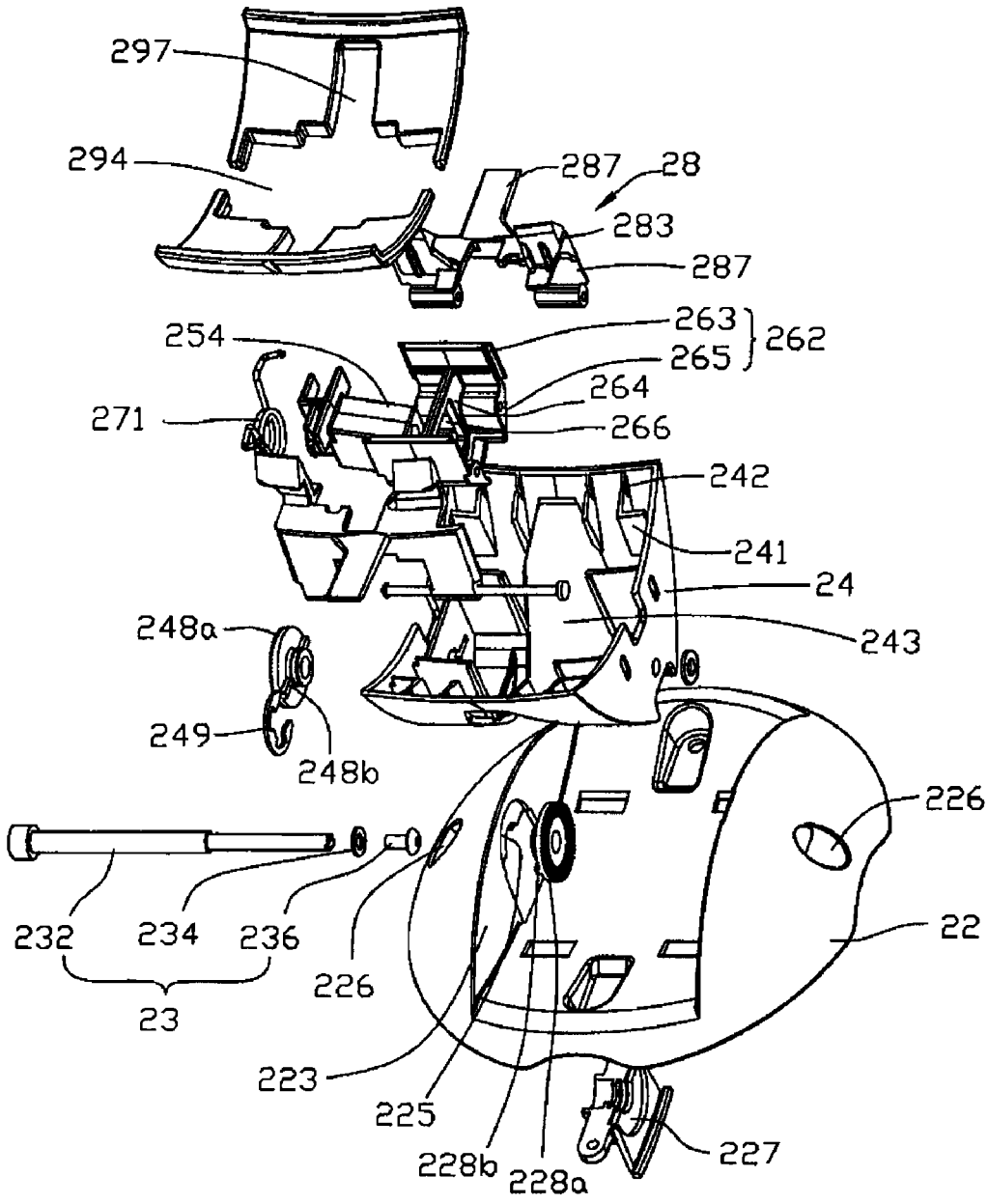
FIG. 7 is similar to FIG. 5, but showing the bracket of the speaker/bracket assembly of FIG. 1 at still another angle of view.

A rubber isolator 29 is disposed on the clamp cup assembly 24, for covering the receiving cavity, as shown in FIG. 6. The rubber isolator is in a shape for fitting the back face of the speaker 10. The rubber isolator 29 defines two central crossing openings 294 and 296. The opening 294 is elongated along the axial direction of the drive screw 23 while the opening 29 is elongated along a direction perpendicular to the drive screw 23. As shown in FIG. 4, the opening 294 allows the two hooks 283 to loosely move therein. The opening 296 is used to provide space for loosely movement (i.e., swing) of the two aerofoil panels 287. A plurality of protrusion flanges 292 are formed at edges around the openings 294 and 296. The plurality of ribs 241 of the clamp cup assembly 24 define a plurality of slots 242 for respectively gnawing the plurality of protrusion flanges 292, thereby fixing the rubber isolator 29 on the clamp cup assembly 24.

The rubber isolator 29 extends two side flanges 297 parallel to the slide groove 11, for engaging two edges of the backing 124. The two side flanges 297 restrict the rubber isolator 29 to slide along a surface of the backing 124, but not generate any offset. The rubber isolator 29 is in an arched shape similar to the arched shape of the backing 124 to couple to the backing 12 and slide along the back face of the backing 124.

The operating process of the speaker/bracket assembly 100 is described in detail as follows.

In operation, to adjust the angle or position of the speaker 10, the wedge block 25 is pushed in the window 266 by rotating the drive screw 23. Meanwhile, the two elastic rods 274 and 276 of the spring 271 slide in the two openings 286 and press against the two baffles 265 of the brake 26, thereby releasing the two hook portions 284 of the two latch hooks 28. The hook portions 284 are still held in the slide groove 11. Consequently, the latching mechanism, i.e., the latch hooks 28, can slide along the slide groove 11 to a desired angle. In other words, the latching mechanism is loosened in the slide groove 11 to adjust the speaker position by moving the speaker 10. After positioning the speaker 10 on a desired angle, the elastic rods 274 and 276 are drawn back out the openings 286 and then press against the two upright panels 281 by rotating the drive screw 23 Accordingly, the hook portions 284 snap into the slide groove 11 by rotating the drive screw 23 again. In the illustrated embodiment, the radian of the backing 124 is about 120 degree. Accordingly, the adjustable span angle of the speaker 10 is in a range of about 0-120 degree. Thus, the present speaker/bracket assembly 100 has a larger adjustable angle.

Further, as described above, the clamp cup assembly 24 may transfer along the drive screw 23 to separate the second knurl ring 248 from the second knurl ring 248. After departing from the two knurl rings 228, 248, the clamp cup assembly 24 can freely revolve along the drive screw 23 to a desired orientation. While adjusting the clamp cup assembly 24 to desired orientation, the clamp cup assembly 24 transfers toward the first knurl ring 228 to recover engagement between the clamp cup assembly 24 and the substrate 22 by the two knurl rings 228 and 248. Accordingly, swaying amplitude of the speaker/bracket assembly 100 around the drive screw 23 can be regulated by such an adjustment of the clamp cup assembly 24. The swaying amplitude is in the range of, for example, about 90 degree.

As such, the speaker/bracket assembly 100 can be adjusted and oriented at desired angles in three dimensional direction according to the adjusting operation described above.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A speaker/bracket assembly comprising:

a speaker defining a slide groove at a back face thereof; and a bracket comprising:

a latching mechanism configured to be loosened to adjust and tightened to set the speaker position, the latching mechanism comprising:

a brake;

a pair of latch hooks disposed on the brake;

a drive mechanism interposed between the pair of latch hooks; and a spring secured on the drive mechanism;

wherein the pair of latch hooks is loosened to set the speaker position and snaps into the slide groove to lock the speaker into the set position when the spring is pushed in and drawn back out the brake by the drive mechanism.

2. The speaker/bracket assembly as claimed in claim 1, wherein the brake comprises a pair of baffles and a bridge panel interposed between the pair of baffles, the bridge panel being substantially perpendicular to an axial direction of the drive mechanism.

3. The speaker/bracket assembly as claimed in claim 2, wherein the drive mechanism comprises a wedge block and a drive screw threadedly engaging with the wedge block, the spring being secured on the wedge block, the spring along with the wedge block being pushed in and drawn back out the brake by rotation of the drive screw.

4. The speaker/bracket assembly as claimed in claim 3, wherein the bridge panel defines a window configured for allowing the wedge block to transfer along an axial direction of the drive screw.

5. The speaker/bracket assembly as claimed in claim 3, wherein each latch hook comprises an upright panel and at least one hook vertically protruding from the upright panel, the hook being partially inserted in the slide groove, each upright panels of the pair of latch hooks defining an opening facing toward one respective baffle of the brake.

6. The speaker/bracket assembly as claimed in claim 5, wherein the spring comprises two elastic rods, the elastic rods being configured for penetrating through the openings of the upright panel to press against the two baffles of the brake and pressing against the two upright panels of the pair of latch hooks when the spring is pushed in and drawn back out the brake by the drive mechanism.

7. The speaker/bracket assembly as claimed in claim 6, wherein the wedge block comprises a wedge portion penetrating through the window and an end portion disposed far away from the window, the wedge portion being inclined to the drive screw, the spring winding around the end portion.

8. The speaker/bracket assembly as claimed in claim 7, wherein a stop member protrudes from the wedge block, the stop member comprising two pairs of barriers, the spring further comprising a major spring winding disposed around the end portion and two upright spring arms extending from two ends of the spring winding, the two elastic rods respectively extending from the two spring arms along the axial direction of the drive screw, each spring arm being held in an interspace defined between one pair of barriers so as to restrict rotation and transfer of the spring in relation to the end portion.

9. The speaker/bracket assembly as claimed in claim 8, wherein the at least one hook comprises two hooks, each hook comprises a connecting panel and an upright hook portion vertically protruding from a free end of the connecting panel, the connecting panel of one latch hook extending along a direction opposite to the extending direction of the connecting panel of the other latch hook, the two hooks of one latch hook and the two hooks of the other latch hook being alternately spaced and arranged along a line substantially parallel to the axial of the drive screw.

10. The speaker/bracket assembly as claimed in claim 9, wherein two aerofoil panels respectively protrude from the pair of latch hooks along a direction opposite to the connecting panel of the respective latch hook.

11. The speaker/bracket assembly as claimed in claim 3, wherein the bracket further comprises a substrate and a clamp cup assembly in connection with the substrate by the drive screw, the clamp cup assembly defining a receiving cavity for receiving the latch mechanism therein.

12. The speaker/bracket assembly as claimed in claim 11, wherein the clamp cup assembly comprises an arched bottom wall and two opposite side walls adjoining the bottom wall at two sides of the bottom wall, the bottom wall defining an arched opening along the arched central line thereof.

13. The speaker/bracket assembly as claimed in claim 11, wherein the substrate is provided with two opposite inner walls projecting therefrom, the two inner walls cooperatively defining a sunken recess therebetween for receiving the clamp cup assembly therein, a first knurl ring being disposed on one of the two inner walls of the substrate, a second knurl ring being disposed on one side wall of the clamp cup assembly adjacent to the one inner wall of the substrate, the first knurl ring engaging with the second knurl ring, the drive screw passing through the two adjacent walls and the two knurl rings.

14. The speaker/bracket assembly as claimed in claim 12, wherein a rubber isolator disposed on the clamp cup assembly for covering the receiving cavity, the rubber isolator being in a shape for fitting the back face of the speaker.

15. The speaker/bracket assembly as claimed in claim 1, wherein the slide groove comprises an inner groove space and a groove opening, the groove opening having an opening dimension smaller than dimension of the inner groove space to lock the latching mechanism in the inner groove.

16. The speaker/bracket assembly as claimed in claim 1, wherein a bottom of the slide groove further defines a cavity for receiving parts associated with the speaker/bracket assembly.

17. The speaker/bracket assembly as claimed in claim 1, wherein the speaker comprises a backbone portion and a backing both in an arched shape and disposed at the back face, the backbone portion defining an inner groove, the backing defining a groove opening communicating with the inner groove, the slide groove comprising the inner groove and the groove opening.

18. The speaker/bracket assembly as claimed in claim 17, wherein the backing comprises a central portion and two end portions disposed at two opposite margins of the central portion, the groove opening being a slot defined in the central portion along a central line thereof.

19. The speaker/bracket assembly as claimed in claim 17, wherein at least one line of scale is graduated along the backbone portion.

20. The speaker/bracket assembly as claimed in claim 1, wherein the slide groove has a radian in the range of no less than 120 degree.

* * * * *